US007374136B1

(12) United States Patent
Perea

(10) Patent No.: US 7,374,136 B1
(45) Date of Patent: May 20, 2008

(54) STAND FOR SUPPORTING CHRISTMAS ACCESSORIES AND THE LIKE

(76) Inventor: Louis P. Perea, P.O. Box 5012, Parker, AZ (US) 85344

( * ) Notice: Subject to any disclaimer, the term of this patent is extended or adjusted under 35 U.S.C. 154(b) by 68 days.

(21) Appl. No.: 11/372,776

(22) Filed: Mar. 13, 2006

(51) Int. Cl.
*F16L 3/00* (2006.01)

(52) U.S. Cl. ..... 248/121

(58) Field of Classification Search ..... 248/121, 248/188.1, 158, 127, 125.9; 211/133.2, 126.9
See application file for complete search history.

(56) References Cited

U.S. PATENT DOCUMENTS

| | | | | |
|---|---|---|---|---|
| 1,747,951 | A * | 2/1930 | Reichert | 211/30 |
| 2,092,691 | A * | 9/1937 | Berghoff | 211/74 |
| 2,187,159 | A * | 1/1940 | Koch | 248/121 |
| 2,794,554 | A * | 6/1957 | Donner | 211/85.23 |
| D289,585 | S | 5/1987 | Lord | |
| 4,770,303 | A * | 9/1988 | Boyd | 211/205 |
| 5,219,081 | A | 6/1993 | Lin | |
| 5,318,189 | A | 6/1994 | Lee | |
| 5,458,249 | A | 10/1995 | Shang-Lu | |
| 5,642,819 | A | 7/1997 | Ronia | |
| 5,873,195 | A * | 2/1999 | Wortham | 47/39 |
| 5,947,306 | A * | 9/1999 | Chang | 211/85.23 |
| 6,983,561 | B2 * | 1/2006 | Warren | 47/39 |
| 2004/0181963 | A1 | 9/2004 | Morris | |

* cited by examiner

*Primary Examiner*—Amy J. Sterling

(57) ABSTRACT

An assembly includes a base that has a planar top surface, an outer edge and decorative members conjoined to the top surface that have a solid core for stabilizing the assembly. An anchor rod is provided with tapered ends, has a bore formed therein, is conjoined to the base top surface, has an outwardly flanging shoulder, and has a hollow interior. First and second connector rods have a greater length than the anchor rod, and are telescopically adaptable with each other. The second rod has slots randomly formed in an outer surface thereof and has a hollow interior. Each slot has an inverted U-shape and has a central tab formed with the second rod outer surface. Arms have a first end positioned through the slots and anchored to the second rod interior. The first ends are provided with a groove interfitted with the tabs.

15 Claims, 5 Drawing Sheets

STAND FOR SUPPORTING CHRISTMAS ACCESSORIES AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to support stands and, more particularly, to a stand for supporting Christmas accessories and the like.

2. Prior Art

It has been common practice for many years now to hang one's Christmas stockings along the mantle of your fireplace for all to see. Although this practice helps to promote the holiday spirit associated with Christmas, it poses a number of serious problems. One particular draw back of displaying Christmas stockings on a fireplace mantle is the fact that one can no longer use the fireplace, since the stockings, which are usually made of wool or other such fabric, might catch on fire.

Placing stockings along the fireplace mantle also requires a person to remove other items that might normally de displayed there. This practice unfortunately increases the chances of such an item becoming misplaced, which can become costly if valuable items are lost. Another drawback of using a fireplace mantle for displaying Christmas stockings is the fact that one has limited space to work with. If the number of family members exceeds the amount of space available, some stockings might have to be displayed apart from the majority of stockings. This is usually aesthetically unappealing, and can cause some family members to feel left out and unimportant.

Accordingly, a need remains for a stand for supporting Christmas accessories and the like in order to overcome the above-noted shortcomings. The present invention satisfies such a need by providing a support stand that has an attractive and festive design, and is easy to use and display. Such an apparatus is positionable throughout the home to provide an attractive means to display Christmas stockings. The support stand also provides an ornate decoration that garners a great deal of attention and enlivens the entire room, while allowing family members to engage in the cherished holiday tradition of hanging their stockings. This effectively creates a holiday ambiance throughout the home, and makes the holiday so much more enjoyable. The support stand also frees up the fireplace mantle such that additional decorations may be placed there instead.

BRIEF SUMMARY OF THE INVENTION

In view of the foregoing background, it is therefore an object of the present invention to provide a stand for supporting Christmas accessories and the like. These and other objects, features, and advantages of the invention are provided by an assembly for displaying holiday paraphernalia at an elevated position.

The assembly includes a base that has a centrally registered longitudinal axis and further has a horizontally oriented planar top surface and a monolithically formed outer edge. Such a base includes a plurality of decorative members permanently conjoined to the top surface and radially extending outwardly therefrom. The decorative members have a solid core for advantageously and effectively weighing down the base member and for maintaining the assembly at a substantially stable position.

An anchor rod is provided with axially tapered end portions. Such an anchor rod has an axial bore formed therein in such a manner that the axial bore is symmetrically and coextensively tapered with the tapered end portions of the anchor rod. A bottom one of the tapered end portions terminates at the top surface of the base. The anchor rod is directly and statically conjoined to the top surface of the base. Such an anchor rod has an outwardly flanging shoulder formed approximately midway between the tapered end portions. Such an anchor rod further has a hollow interior in fluid communication with the slots.

A first elongated and rectilinear connector rod has an inner surface rotatably conjoined directly to an outer surface of a top one of the tapered end portions of the anchor rod. Such a first connector rod has a plurality of holes formed in an outer surface thereof.

A second elongated and rectilinear connector rod has a longitudinal length greater than a longitudinal length of the anchor rod. Such a second connector rod is telescopically adaptable with the first connector rod such that the first and second connector rods can effectively be statically attached directly to each other as desired by the user. The second connector rod has a plurality of coextensively shaped slots randomly formed in an outer surface thereof. Such slots may be vertically aligned parallel to the longitudinal axis such that the user can effectively attached at least three rows of the arms directly to the second connector rod. The second connector rod has a hollow interior in fluid communication with the slots. Each slot has an inverted U-shape and further has a central tab portion monolithically formed with the outer surface of the second connector rod.

A plurality of coextensively shaped arms have a first end portion directly positioned through the slots and anchored to the hollow interior of the second connector rod. Such first end portions are provided with a groove directly and removably interfitted with corresponding ones of the tabs. The arms preferably have a second end portion outwardly spaced from the second connector rod that is radially disposed away from the axis. Such arms maintain a static spatial relationship with the second connector rod when the first and second connector rods are rotated in sync about the axis. A plurality of fasteners are removably attached directly to the second end portions of the arms such that the stockings effectively become suspended above a ground surface. The arms preferably extend outwardly from the second connector rod and have a hooked end portion provided with an eyelet for conveniently and effectively supporting objects at an elevated position. Such arms preferably further have a hollow core continuously extending through an entire longitudinal length thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
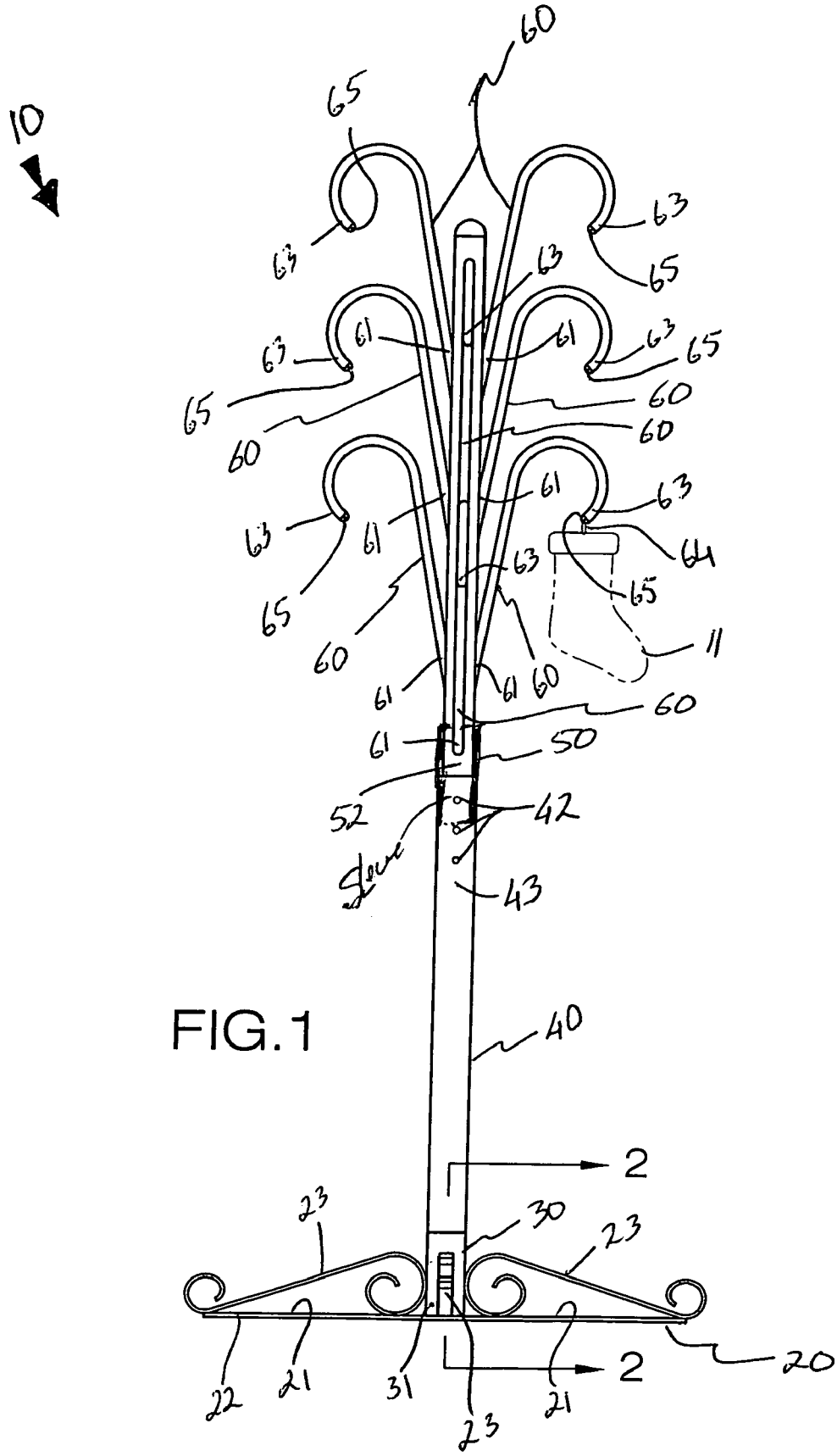
FIG. 1 is a front-elevational view showing a stand for supporting Christmas accessories and the like, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-4 by the reference numeral 10 and is intended to provide a stand for Christmas accessories and the like. It should be understood that the assembly 10 may be used to support many different types of items and should not be limited in use to only supporting Christmas stockings.

Figure 2:
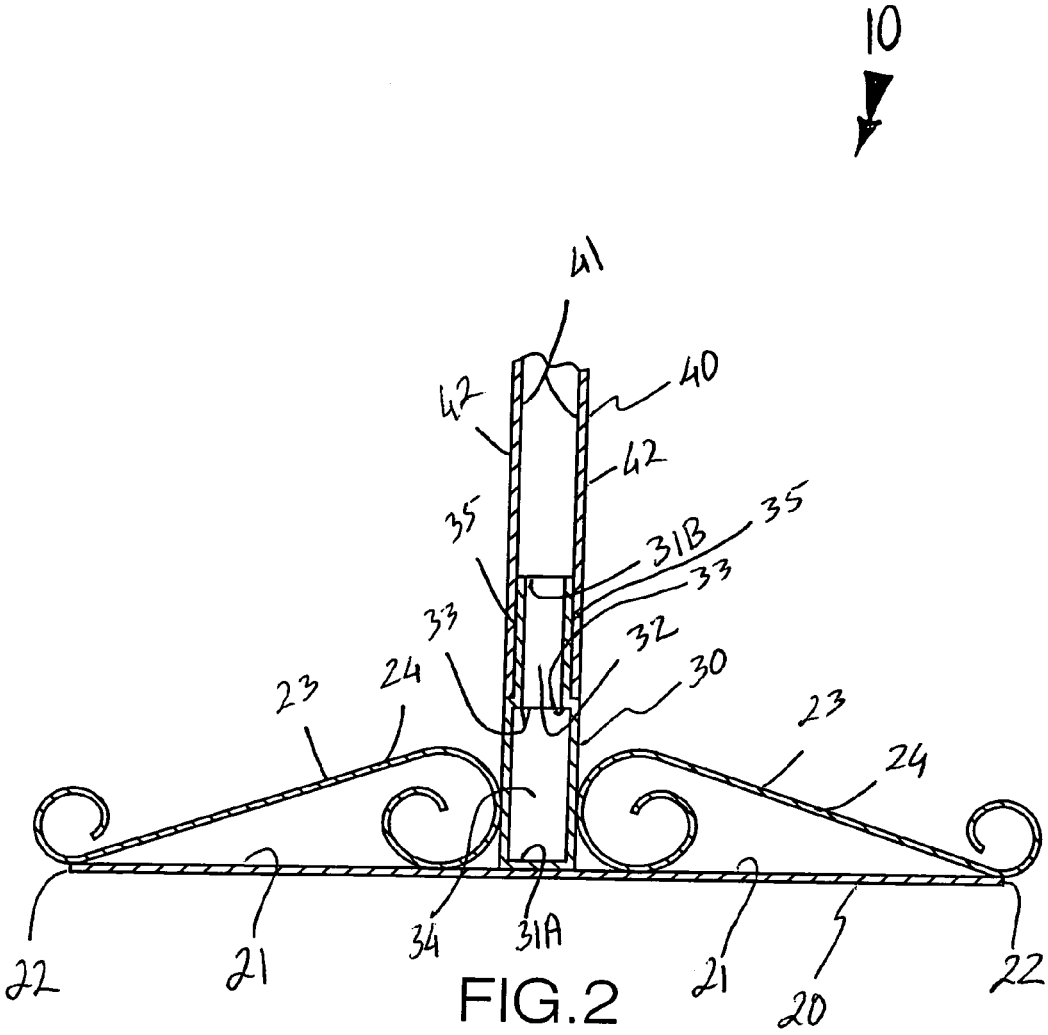
FIG. 2 is a cross-sectional view of the assembly shown in FIG. 1, taken along line 2-2 and showing the anchor rod connected to the base rod.
Figure 5:
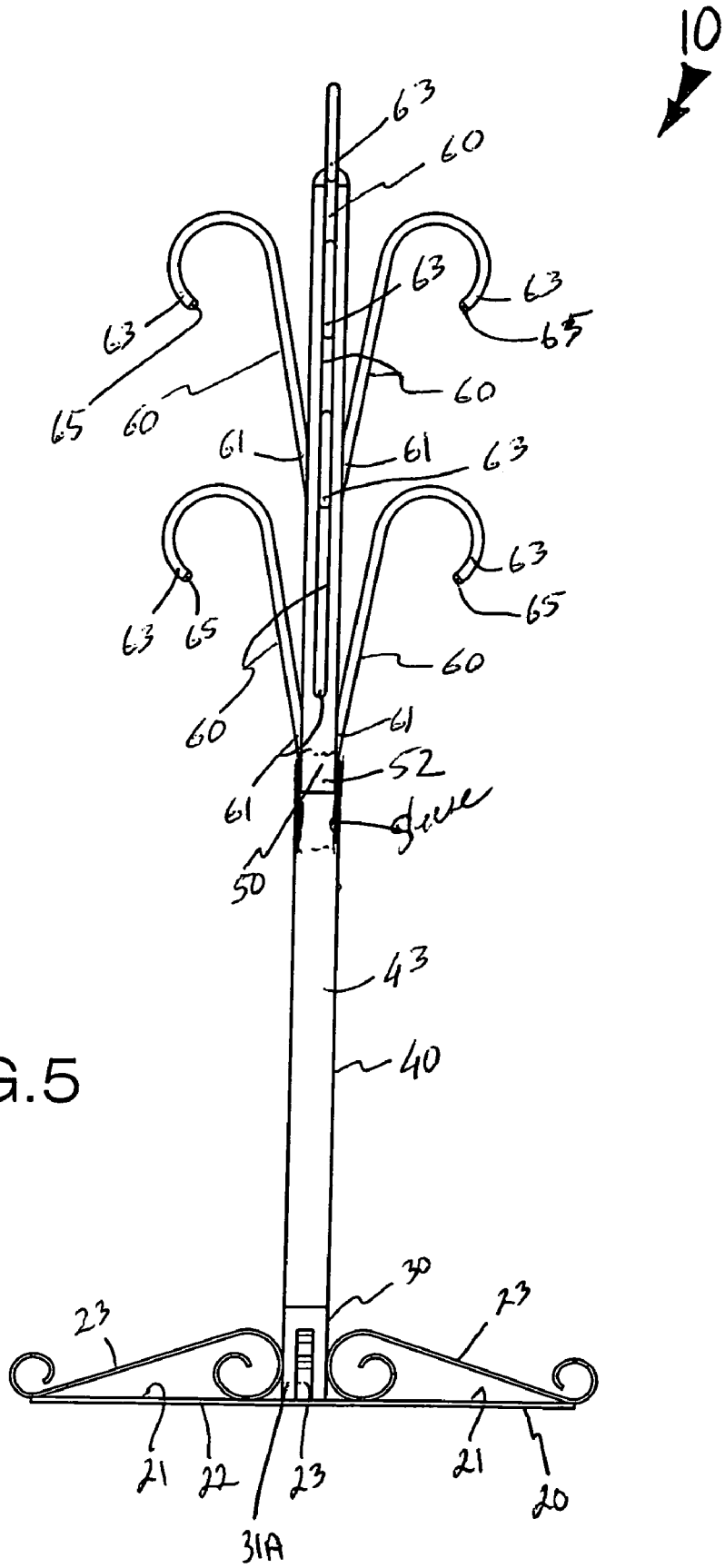
FIG. 5 is a side-elevational view of the assembly shown in FIG. 1.

Referring initially to FIGS. 1, 2 and 5, the assembly 10 includes a base 20 that has a centrally registered longitudinal axis and further has a horizontally oriented planar top surface 21 and a monolithically formed outer edge 22. Such a base 20 includes a plurality of decorative members 23 permanently conjoined, without the use of intervening elements, to the top surface 21 and radially extending outwardly therefrom. Of course, the decorative members 23 may be formed in a variety of alternate shapes and sizes and may be alternately oriented on the base top surface 21, as is obvious to a person of ordinary skill in the art. The decorative members 23 have a solid core 24, which is essential and advantageous for effectively weighing down the base member 20 and for maintaining the assembly 10 at a substantially stable position.

Still referring to FIGS. 1, 2 and 5, an anchor rod 30 is provided with axially tapered end portions 31. Such an anchor rod 30 has an axial bore 32 formed therein in such a manner that the axial bore 32 is symmetrically and coextensively tapered with the tapered end portions 31 of the anchor rod 30. A bottom one 31A of the tapered end portions 31 terminates at the top surface 21 of the base 20, as is best shown in FIG. 2. The anchor rod 30 is directly and statically conjoined, without the use of intervening elements, to the top surface 21 of the base 20. Such an anchor rod 30 has an outwardly flanging shoulder 33 formed approximately midway between the tapered end portions 31, as is illustrated in FIG. 2. The anchor rod 30 further has a hollow interior 34 in fluid communication with the slots.

Again referring to FIGS. 1, 2 and 5, a first elongated and rectilinear connector rod 40 has an inner surface 41 rotatably conjoined directly, with out the use of intervening elements, to an outer surface 35 of a top one 31B of the tapered end portions 31 of the anchor rod 30. This is a crucial feature for allowing the first connector rod 40 to be disengaged from the anchor rod 30 in such a manner that the assembly 10 can advantageously and conveniently be stored at a more compact position when not in use. Such a first connector rod 40 has a plurality of holes 42 formed in an outer surface 43 thereof, as is best shown in FIG. 1.

Figure 3:
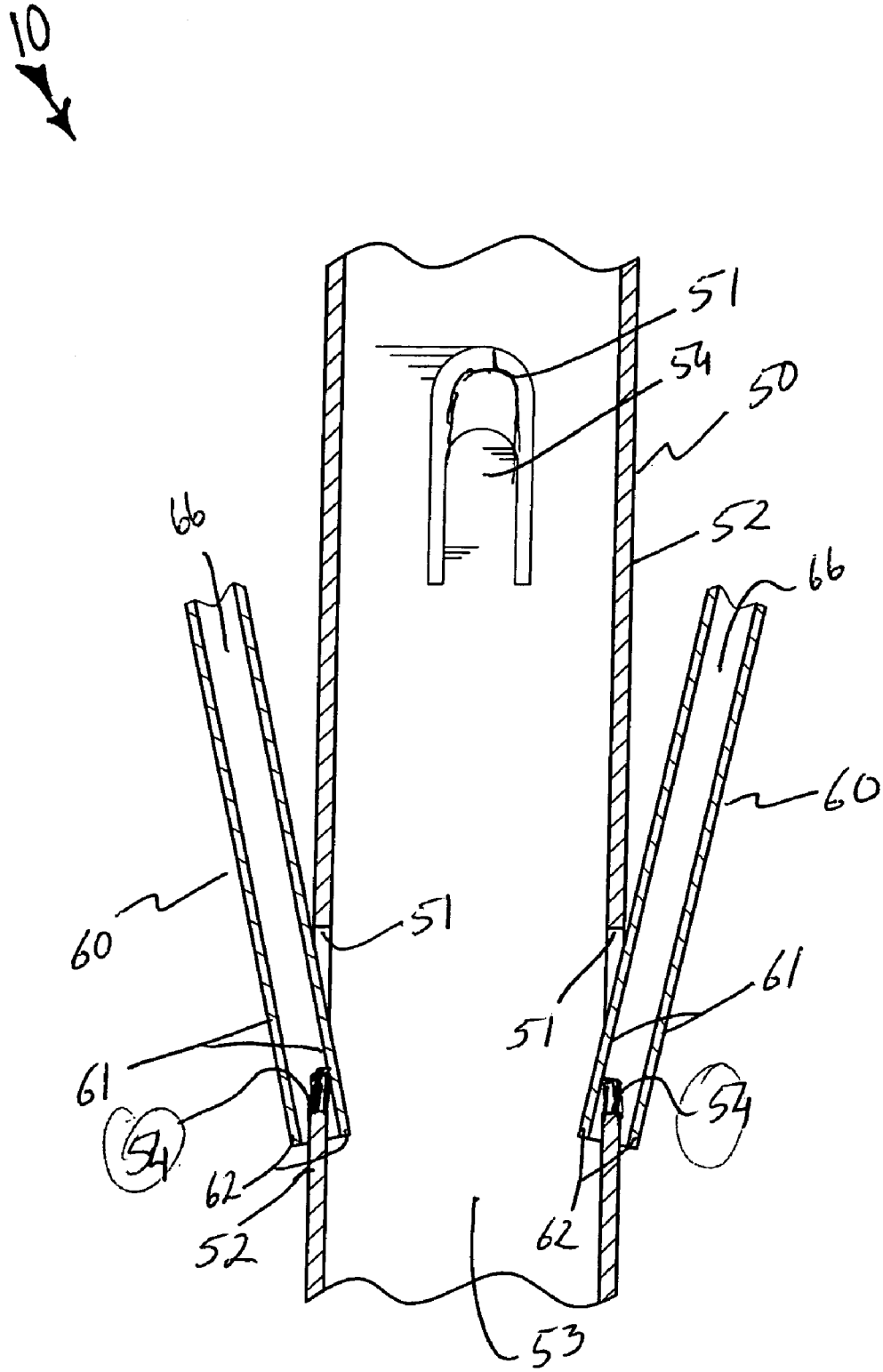
FIG. 3 is an enlarged cross-sectional view of the second connector rod shown in FIG. 1, showing the first end portion of the arms positioned through their respective slots.
Figure 4:
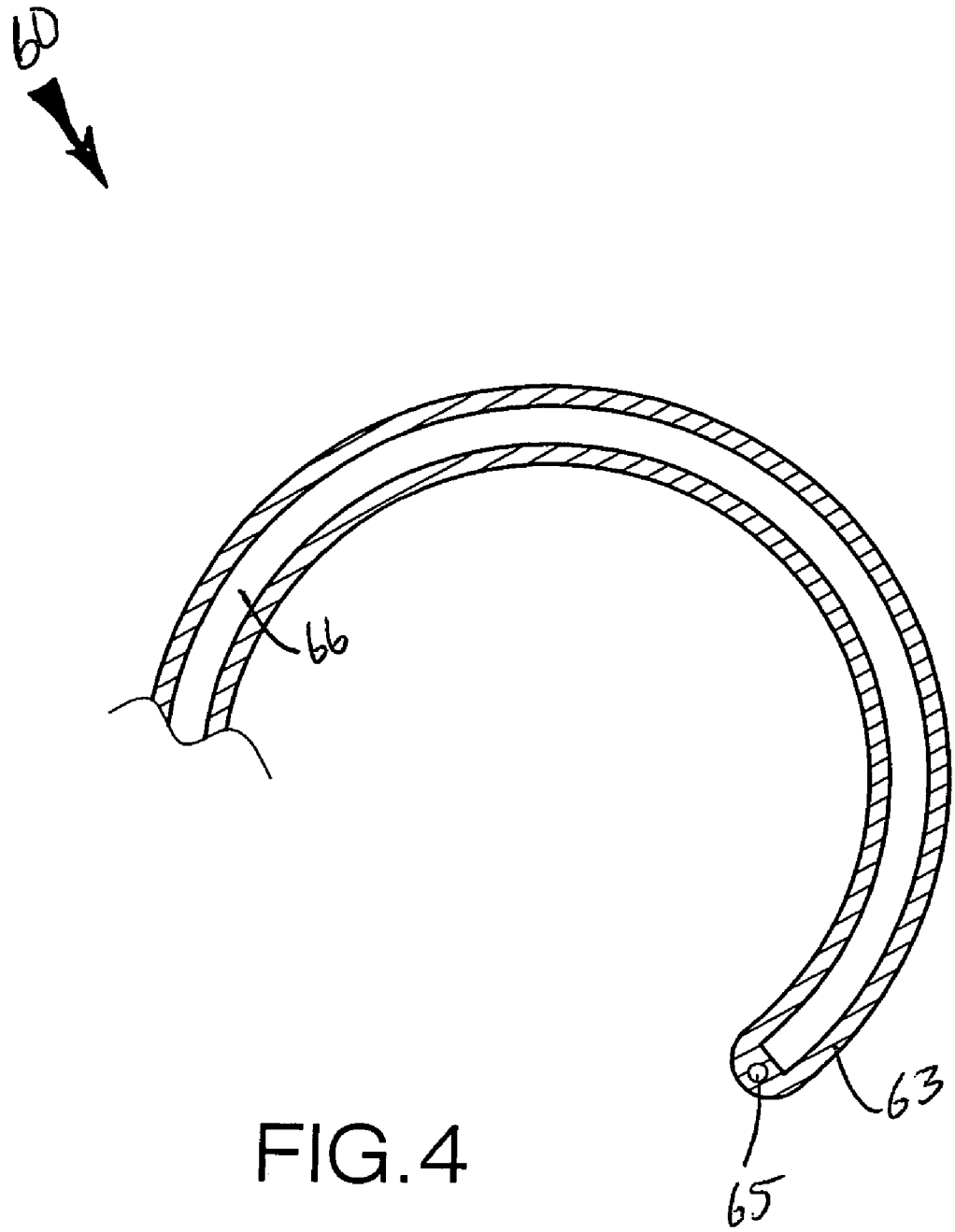
FIG. 4 is an enlarged cross-sectional view of the second end portion of the arms shown in FIG. 1.

Referring to FIGS. 1, 3 and 5, a second elongated and rectilinear connector rod 50 has a longitudinal length greater than a longitudinal length of the anchor rod 30 and the first connector rod 40. Such a second connector rod 50 is telescopically adaptable with the first connector rod 40, which is crucial such that the first 40 and second 50 connector rods can effectively be statically attached directly, without the use of intervening elements, to each other as desired by the user.

The second connector rod 50 has a plurality of coextensively shaped slots 51 randomly formed in an outer surface 52 thereof. Such slots 51 are vertically aligned parallel to the longitudinal axis such that the user can effectively attached at least three rows of the arms 60 (described herein below) directly, without the use of intervening elements, to the second connector rod 50. Of course, the second connector rod 50 may have any number of slots 51 for creating a varying amount of rows of arms 60, as is obvious to a person of ordinary skill in the art. The second connector rod 50 has a hollow interior 53 in fluid communication with the slots 51. Each slot 51 has an inverted U-shape and further has a central tab portion 54 monolithically formed with the outer surface 52 of the second connector rod 50.

Referring to FIGS. 1, 3, 4 and 5, a plurality of coextensively shaped arms 60 have a first end portion 61 directly positioned, without the use of intervening elements, through the slots 51 and anchored to the hollow interior 53 of the second connector rod 50, as is best shown in FIG. 3. Such first end portions 61 are provided with a groove 62 directly and removably interfitted, without the use of intervening elements, with corresponding ones of the tabs 54. The arms 60 have a second end portion 63 outwardly spaced from the second connector rod 50 that is radially disposed away from the axis. Of course, the arms 60 may be arranged about the second connector rod 50 in a variety of alternate patterns like vertical rows, rings and helical spirals, as is obvious to a person of ordinary skill in the art.

Such arms 60 maintain a static spatial relationship with the second connector rod 50 when the first 40 and second 50 connector rods are rotated in sync about the axis. A plurality of fasteners 64 are removably attached directly, without the use of intervening elements, to the second end portions 63 of the arms 60, which is vital such that the stockings 11 effectively become suspended above a ground surface. Of course, the fasteners 64 may be employed for suspending a variety of alternate items from the arms 60, as is obvious to a person of ordinary skill in the art. The arms 60 extend outwardly from the second connector rod 50 and have a hooked end portion 63 provided with an eyelet 65 for conveniently and effectively supporting objects 11 at an elevated position. Such arms 60 further have a hollow core 66 continuously extending through an entire longitudinal length thereof.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An assembly for displaying holiday paraphernalia at an elevated position, said assembly comprising:

a base having a centrally registered longitudinal axis and further having a horizontally oriented planar top surface and a monolithically formed outer edge, said base including a plurality of decorative members permanently conjoined to said top surface and radially extending outwardly therefrom, said decorative members having a solid core for weighing down said base member and maintaining said assembly at a substantially stable position, an anchor rod provided with and an axial bore formed therein, a bottom one of said end portions terminating at said top surface of said base, said anchor rod being directly and statically conjoined to said top surface of said base, said anchor rod having an outwardly flanging shoulder formed approximately midway between said end portions;

a first elongated and connector rod having an inner surface conjoined directly to an outer surface of a top one of said end portions of said anchor rod, said first connector rod having a plurality of holes formed in an outer surface thereof;

a second elongated and connector rod having a longitudinal length greater than a longitudinal length of said anchor rod, said second connector rod being telescopically adaptable with said anchor rod such that said first and second connector rods can be statically attached directly to each other as desired by the user, said second connector rod having a plurality of slots randomly formed in an outer surface thereof, said second connector rod having a hollow interior in fluid communication with said slots, wherein each said slots has an inverted U-shape and further has a central tab portion monolithically formed with said outer surface of said second connector rod, said anchor rod having a hollow interior in fluid communication with said slots; and a plurality of arms having a first end portion directly positioned through said slots and anchored to said hollow interior of said second connector rod, said first end portions being directly and removably interfitted with corresponding ones of said tabs.

2. The assembly of claim 1, wherein said arms have a second end portion outwardly spaced from said second connector rod and radially disposed away from the axis, said arms maintaining a static spatial relationship with said second connector rod when said first and second connector rods are rotated in sync about the axis, a plurality of fasteners being removably attached directly to said second end portions of said arms such that said stockings become suspended above a ground surface.

3. The assembly of claim 1, wherein each said arms has a hollow core continuously extending through an entire longitudinal length of said arms.

4. The assembly of claim 1, wherein said slots are vertically aligned parallel to said longitudinal axis such that the user can attached at least three rows of said arms directly to said second connector rod.

5. The assembly of claim 1, wherein said arms extend outwardly from said second connector rod and have a hooked end portion provided with an eyelet for supporting objects at an elevated position.

6. An assembly for displaying holiday paraphernalia at an elevated position, said assembly comprising:

a base having a centrally registered longitudinal axis and further having a horizontally oriented planar top surface and a monolithically formed outer edge, said base including a plurality of decorative members permanently conjoined to said top surface and radially extending outwardly therefrom, said decorative members having a solid core for weighing down said base member and maintaining said assembly at a substantially stable position, an anchor rod provided with, said anchor rod having an axial bore formed therein and in such a manner that said axial bore is with said end portions of said anchor rod, a bottom one of said end portions terminating at said top surface of said base, said anchor rod being directly and statically conjoined to said top surface of said base, said anchor rod having an outwardly flanging shoulder formed approximately midway between said end portions;

a first elongated and connector rod having an inner surface conjoined directly to an outer surface of a top one of said end portions of said anchor rod, said first connector rod having a plurality of holes formed in an outer surface thereof;

a second elongated and connector rod having a longitudinal length greater than a longitudinal length of said anchor rod, said second connector rod being telescopically adaptable with said anchor rod such that said first and second connector rods can be statically attached directly to each other as desired by the user, said second connector rod having a plurality of slots randomly formed in an outer surface thereof, said second connector rod having a hollow interior in fluid communication with said slots, wherein each said slots has an inverted U-shape and further has a central tab portion monolithically formed with said outer surface of said second connector rod, said anchor rod having a hollow interior in fluid communication with said slots; and a plurality of coextensively shaped arms having a first end portion directly positioned through said slots and anchored to said hollow interior of said second connector rod, said first end portions being provided with directly and removably interfitted with corresponding ones of said tabs.

7. The assembly of claim 6, wherein said arms have a second end portion outwardly spaced from said second connector rod and radially disposed away from the axis, said arms maintaining a static spatial relationship with said second connector rod when said first and second connector rods are rotated in sync about the axis, a plurality of fasteners being removably attached directly to said second end portions of said arms such that said stockings become suspended above a ground surface.

8. The assembly of claim 6, wherein each said arms has a hollow core continuously extending through an entire longitudinal length of said arms.

9. The assembly of claim 6, wherein said slots are vertically aligned parallel to said longitudinal axis such that the user can attached at least three rows of said arms directly to said second connector rod.

10. The assembly of claim 6, wherein said arms extend outwardly from said second connector rod and have a hooked end portion provided with an eyelet for supporting objects at an elevated position.

11. An assembly for displaying holiday paraphernalia at an elevated position, said assembly comprising:

a base having a centrally registered longitudinal axis and further having a horizontally oriented planar top surface and a monolithically formed outer edge, said base including a plurality of decorative members permanently conjoined to said top surface and radially extending outwardly therefrom, said decorative members having a solid core for weighing down said base member and maintaining said assembly at a substantially stable position, an anchor rod provided with, said anchor rod having an axial bore formed therein and in such a manner that said axial bore is with said end portions of said anchor rod, a bottom one of said end portions terminating at said top surface of said base, said anchor rod being directly and statically conjoined to said top surface of said base, said anchor rod having an outwardly flanging shoulder formed approximately midway between said end portions;

a first elongated and connector rod having an inner surface conjoined directly to an outer surface of a top one of said end portions of said anchor rod, said first connector rod having a plurality of holes formed in an outer surface thereof;

a second elongated and connector rod having a longitudinal length greater than a longitudinal length of said anchor rod, said second connector rod being telescopically adaptable with said anchor rod such that said first and second connector rods can be statically attached directly to each other as desired by the user, said second connector rod having a plurality of coextensively shaped slots randomly formed in an outer surface thereof, said second connector rod having a hollow interior in fluid communication with said slots, wherein each said slots has an inverted U-shape and further has a central tab portion monolithically formed with said outer surface of said second connector rod, said anchor rod having a hollow interior in fluid communication with said slots; and a plurality of coextensively shaped arms having a first end portion directly positioned through said slots and anchored to said hollow interior of said second connector rod, said first end portions being provided with a directly and removably interfitted with corresponding ones of said tabs.

12. The assembly of claim 11, wherein said arms have a second end portion outwardly spaced from said second connector rod and radially disposed away from the axis, said arms maintaining a static spatial relationship with said second connector rod when said first and second connector rods are rotated in sync about the axis, a plurality of fasteners being removably attached directly to said second end portions of said arms such that said stockings become suspended above a ground surface.

13. The assembly of claim 11, wherein each said arms has a hollow core continuously extending through an entire longitudinal length of said arms.

14. The assembly of claim 11, wherein said slots are vertically aligned parallel to said longitudinal axis such that the user can attached at least three rows of said arms directly to said second connector rod.

15. The assembly of claim 11, wherein said arms extend outwardly from said second connector rod and have a hooked end portion provided with an eyelet for supporting objects at an elevated position.

* * * * *